United States Patent [19]

Rodth et al.

[11] Patent Number: 4,555,045

[45] Date of Patent: Nov. 26, 1985

[54] ICE-COOLED DISPENSING SYSTEM

[75] Inventors: Joseph J. Rodth, Barkhamsted, Conn.; Ira A. Smith, Jr., Marietta; Donald F. Cornett, Cartersville, both of Ga.

[73] Assignee: The Coca-Cola Company, Atlanta, Ga.

[21] Appl. No.: 537,925

[22] Filed: Sep. 30, 1983

[51] Int. Cl.[4] ..... B67D 5/56

[52] U.S. Cl. ..... 222/1; 222/129.1; 222/130; 222/146.6; 165/169; 62/396

[58] Field of Search ..... 222/146.6, 129.1, 129.2, 222/129.3, 129.4, 1, 130; 62/396, 398, 400; 165/168, 169; 312/290, 295, 308, 323

[56] References Cited

U.S. PATENT DOCUMENTS

| | | | |
|---|---|---|---|
| 1,435,883 | 11/1922 | Spohn . | |
| 1,503,811 | 8/1924 | Bastian . | |
| 1,720,967 | 9/1926 | Saugman . | |
| 2,121,841 | 6/1938 | Tweed . | |
| 2,673,005 | 3/1954 | Brown . | |
| 2,998,162 | 8/1961 | Varnell . | |
| 3,011,323 | 12/1961 | Jaeger | 165/169 |
| 3,108,718 | 10/1963 | Seener . | |
| 3,240,395 | 3/1966 | Carver . | |
| 3,331,536 | 7/1967 | DeLorenzo | 222/129.1 |
| 4,008,832 | 2/1977 | Rodth . | |
| 4,230,381 | 10/1980 | Rhoades | 312/295 |
| 4,260,069 | 4/1981 | Juergens | 312/295 |
| 4,291,546 | 9/1981 | Rodth . | |
| 4,423,830 | 1/1984 | Lents et al. | 222/146.6 |

OTHER PUBLICATIONS

Brochure—"Selmix Regent III".
Brochure—"Dole Citation".
Brochure—"The Multiplex Meteor III".

*Primary Examiner*—Joseph J. Rolla
*Assistant Examiner*—Louise S. Heim

[57] ABSTRACT

An ice-cooled gravity beverage dispensing system in which the ice used for cooling the syrup and the water can also be used as potable ice in the drink. The syrup compartment is completely separated from the ice bin and access to the syrup compartment is provided only when the syrup compartment cover has been moved to a position covering the ice bin. A cooling syrup tube embedded in the ice bin cold plate and having a particular diameter allows flash cooling of the syrup.

22 Claims, 11 Drawing Figures

ICE-COOLED DISPENSING SYSTEM

BACKGROUND OF THE INVENTION

1. Field of the Invention

This invention relates generally to an ice-cooled gravity dispensing system and in particular to such a system in which the ice can be used not only to cool the water and the syrup, but also as potable ice in the drink.

2. Description of the Prior Art

In many locations where it is desired to dispense carbonated beverages, it is either impossible or undesirable to provide a mechanical refrigeration system run by electricity. Examples of such locations are ball parks, circuses, carnivals, large picnic or social gatherings, and a variety of other such situations at which limited usage does not warrant the installation of a full-scale mechanical refrigerating apparatus. In such locations, it is known to use ice-cooled dispensers in which the water and the syrup are cooled by the use of ice contained in an ice bin.

The two known types of ice-cooled dispensers are the pressurized dispensers and the gravity dispensers. A pressurized dispenser uses a figal containing the syrup and a $CO_2$ tank for forcing the syrup from the figal through syrup tubes in an aluminum casting cold plate forming the ice bin which contains a quantity of ice to "flash cool" the syrup as well as carbonated water which also flows through separate cooling tubes embedded in the aluminum casting cold plate. The syrup cooling tubes have a maximum O.D. of $\frac{3}{8}$ inch. Pressures of from about 10 to 40 psig are used to push the syrup through these syrup tubes. The ice in the ice bin of a pressurized dispenser can be used not only for cooling the syrup and the water but also as potable ice in the drink.

The other type of known ice-cooled dispenser is the ice-cooled gravity dispenser. The much smaller pressure available in a gravity dispenser (about a four inch head) is not sufficient to force the syrup through such cooling tubes with satisfactory flow rates, thus "flash cooling" has not been used. Instead, the syrup is cooled by positioning the syrup tanks directly in the ice bin and cooling the entire mass of syrup. In all of these known ice-cooled gravity dispensers, the syrup from one syrup tank is fed to a respective one of one or more dispensing valves at a constant flow rate controlled by a float mechanism located in each tank that maintains a constant level of syrup in that tank. The syrup tanks have always been located behind the front wall of the ice bin. The syrup flows down through an outlet in the bottom of the syrup tank directly to a dispenser valve. In all of these ice-cooled gravity dispensers due to the health requirements involved, in particular the risk of contamination of the cooling ice, the ice utilized for cooling the flavoring syrup and the carbonated or sweet water can not also be used as potable ice in the drink.

It is an object of the present invention to provide an ice-cooled gravity dispenser in which the cooling ice can also be used as the potable ice in the drink.

It is a further object of the present invention to provide an ice-cooled gravity dispenser having a syrup compartment completely separated from the ice bin, having oversized syrup tubes embedded in an aluminum casting cold plate wall of the ice bin, having a syrup compartment cover being movable only back and forth between a first position covering the syrup compartment opening and a second position covering the ice bin opening, and having means for preventing the syrup compartment cover from being removed from the housing and from moving to any other positions than said first and second positions, whereby access to the syrup compartment is provided only when the syrup compartment cover is in its second position covering the ice bin.

It is another object of the present invention to provide an ice-cooled gravity dispenser using flash cooling of the syrup.

It is a still further object of this invention to provide a method and apparatus for flash cooling using oversized syrup cooling tubes having an I.D. of from about $\frac{5}{8}$ inch to about $1\frac{1}{4}$ inch, and preferably about $\frac{3}{4}$ inch.

It is a further object of this invention to provide a cold plate that can be used to provide flash cooling in both a gravity dispenser and a pressurized dispenser.

It is a still further object of this invention to provide a method and apparatus that eliminates the necessity of having to cool a large mass of syrup in a cooling tank which also allows flexibility in dispensing system conversions from gravity to pressure systems.

SUMMARY OF THE INVENTION

An ice-cooled gravity beverage dispenser including a housing, a syrup compartment in the housing having an opening providing access into the syrup compartment, the syrup compartment being adapted to receive at least one syrup tank (and preferably four syrup tanks) therein, the syrup tanks each having a removable lid thereon, and an ice bin in the housing having an opening for providing access into the ice bin and being adapted to receive cooling ice. The syrup compartment includes a wall means for completely separating the syrup compartment from the ice bin. One dispensing valve is mounted on the front of the housing for each of the syrup tanks located in the syrup compartment. A cooling syrup tube for feeding syrup from the syrup tank to the dispensing valve is embedded in the bottom wall of the ice bin for cooling the syrup by means of ice in the ice bin, prior to the syrup reaching the dispensing valve. The bottom wall of the ice bin is an aluminum casting cold plate and the syrup tube has an O.D. of from about $\frac{5}{8}$ inch to about $1\frac{1}{4}$ inch, and preferably has an I.D. of about $\frac{3}{4}$ inch.

A syrup compartment cover fits over and closes the syrup compartment opening and is movable only back and forth between a first position covering the syrup compartment opening and a second position covering the ice bin opening. Means are provided for preventing the syrup compartment cover from being removed from the housing and from moving to any other positions, except of course the intermediate positions during the movement of the syrup compartment cover back and forth between said first and second positions, whreby access to the syrup compartment is provided only when the syrup compartment cover is in its second position covering the ice bin. In the preferred embodiment, a second cover is provided for the ice bin which cover can be pivotedly lifted up and slid over on top of the syrup compartment cover to provide access to the ice in the ice bin. The ice bin cover preferably includes two eyelets underneath the front edge thereof which eyelets engage a pair of mating U-shaped hooks positioned adjacent the front edge of the syrup compartment cover. By lifting the ice bin cover, the hooks engage and interlock with the eyelets to connect the two covers together after which they can be moved or slid forward as a unit to open the syrup compartment and to close and cover the ice bin. In this fashion, an ice-cooled gravity dispenser is provided in which the cooling ice may also be utilized as potable ice.

BRIEF DESCRIPTION OF THE DRAWINGS

The present invention will be more fully understood from the detailed description below when read in connection with the accompanying drawings which are given by way of illustration only and thus are not limitative of the invention and wherein like reference numerals refer to like elements, and wherein.

DETAILED DESCRIPTION OF THE PREFERRED EMBODIMENT

Figure 1:
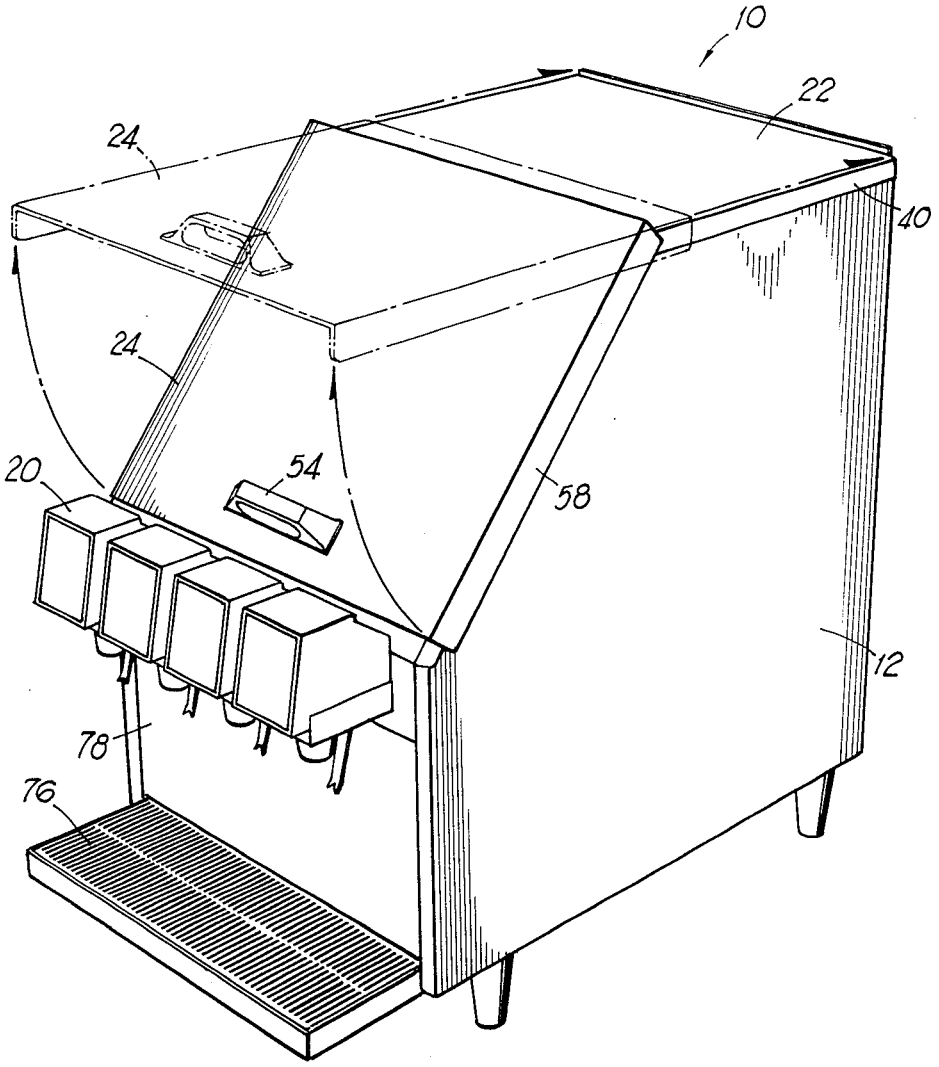
FIG. 1 is a perspective view of the dispenser of this invention showing the ice bin cover lifted up in phantom lines.

With reference now to the drawings, FIGS. 1–11 show an ice-cooled gravity dispenser 10 according to the present invention. The dispenser 10 includes a housing 12, a syrup compartment 14 (see FIG. 3), a plurality of syrup tanks 16 (see FIGS. 3, 4 & 5) located in the syrup compartment 14, an ice bin 18, a plurality of dispensing valves 20 mounted on the front of the housing 10, a syrup compartment cover 22, and an ice bin cover 24.

Figure 2:
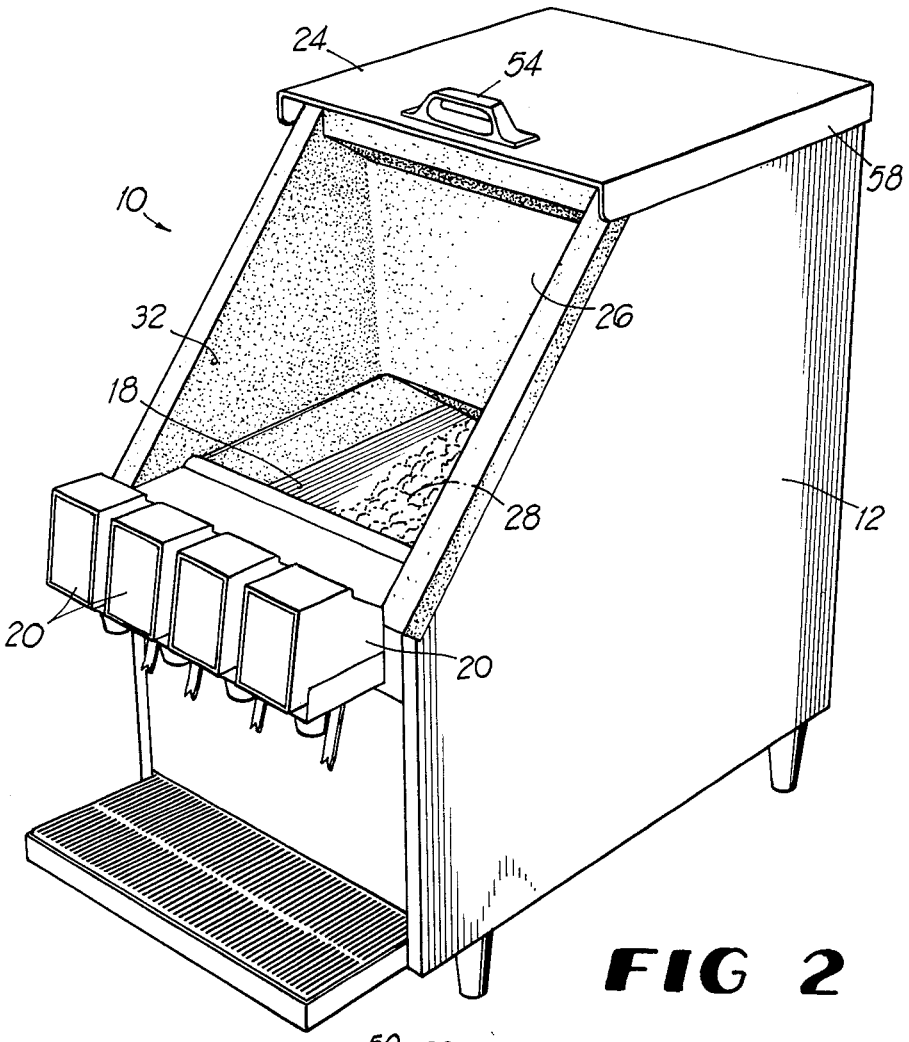
FIG. 2 is a perspective view of the dispenser of FIG. 1 with the ice bin cover moved up on top of the syrup compartment cover.
Figure 3:
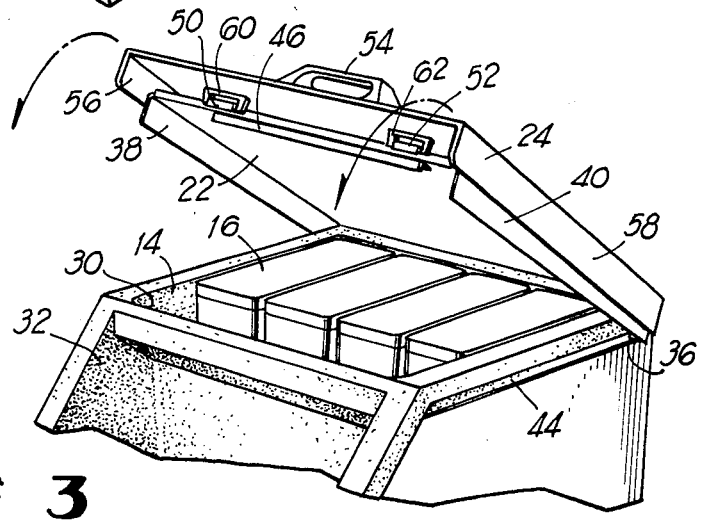
FIG. 3 is a partial perspective view of the top of the dispenser as on FIG. 2 but with two top covers lifted up revealing the syrup compartment.
Figure 4:
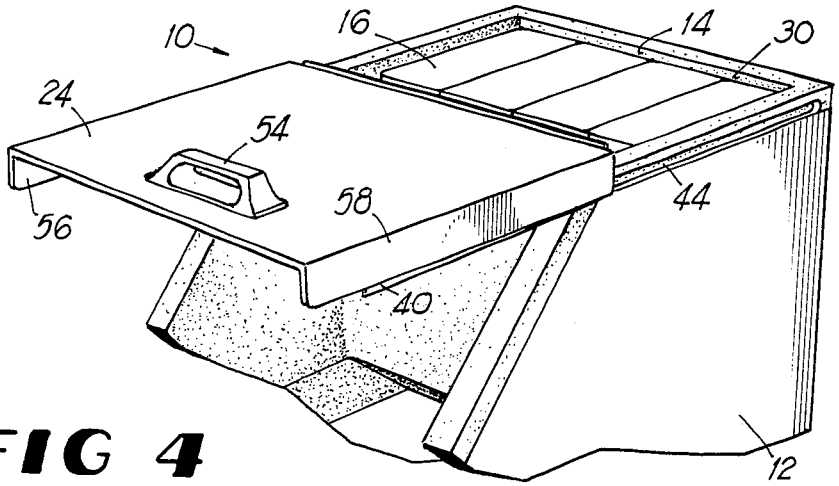
FIG. 4 is a perspective view of the dispenser of FIG. 1 showing the two interlocked covers moved partially forward off of the syrup compartment.

The syrup compartment 14 is completely separated from the ice bin 18 by a wall 26 (see FIG. 2, for example). The ice bin cover 24 is lifted up to allow a quantity of ice 28 (see FIG. 2) to be deposited into the ice bin to provide cooling for the syrup and carbonated water (as described below) and to provide potable ice for the drink. The ice 28 in the ice bin does not cool the mass of syrup that is located in the syrup tanks 16.

The dispenser 10 includes means for providing access to the syrup compartment 14 only when the ice bin 18 is covered, as will now be described. The syrup compartment 14 has an opening 30 (see FIG. 3) providing access thereto when the cover 22 is opened, and the ice bin 18 has an opening 32 providing access thereto when the cover 24 is opened. As shown in FIGS. 1–8, the cover 22 includes a pair of pins 34 and 36 (see FIGS. 3 and 10) that extend inwardly from a pair of downwardly extending flanges 38 and 40 on opposite sides of the cover 22. The pins 34 and 36 are captured in, but are slidably movable along, a pair of grooves 42 and 44 in the housing 10 adjacent opposite sides of the opening 30. The cover 22 can also pivot about the pins 34 and 36. The cover 22 includes a downwardly extending flange 46 (see FIGS. 3 and 6–8) along its front edge that abuts against a surface 48 in the housing (see FIG. 6) and which prevents the cover 22 from sliding forward without first lifting the front edge thereof upwardly to free the flange 46 from the surface 48. The cover 22 also includes a pair of spaced-apart U-shaped hooks 50 and 52 (see FIGS. 3 and 6–8) along its front edge for interconnecting the two covers 22 and 24.

The ice bin cover 24 includes a handle 54, a pair of downwardly extending side flanges 56 and 58 and a pair of spaced-apart, downwardly extending eyelets 60 and 62 adjacent and underneath its front edge and adapted to matingly engage or connect to the hooks 50 and 52. The eyelets 60 and 62 are formed as flanges with elongated openings therein of a size and shape to engage the hooks 50 and 52. When it is desired to provide access to the ice bin 18, the handle 54 is grasped and the cover 24 is thereby lifted as shown in phantom lines in FIG. 1. The ice bin cover 24 can be lifted completely off of the housing 10, if desired.

Figure 5:
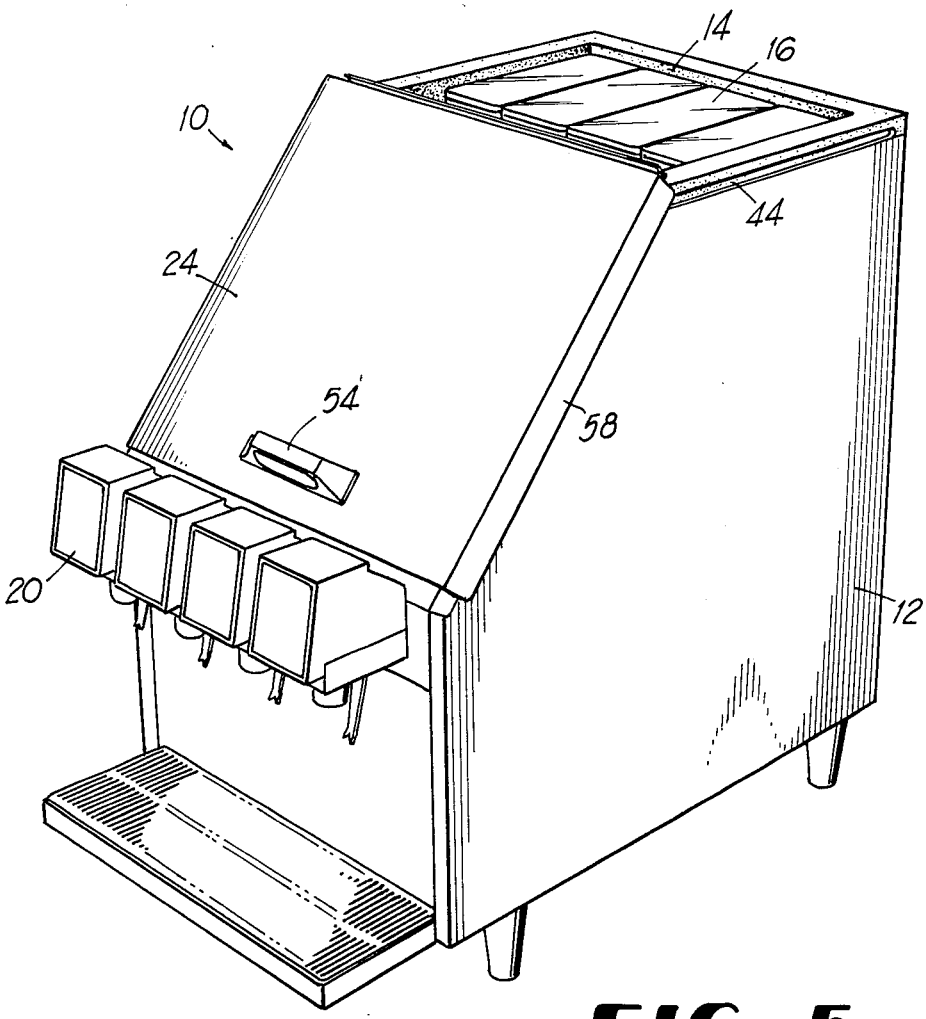
FIG. 5 is a perspective view of the dispenser of FIG. 1 showing the two interlocked covers moved completely off of the syrup compartment and completely covering the ice bin.
Figure 6:
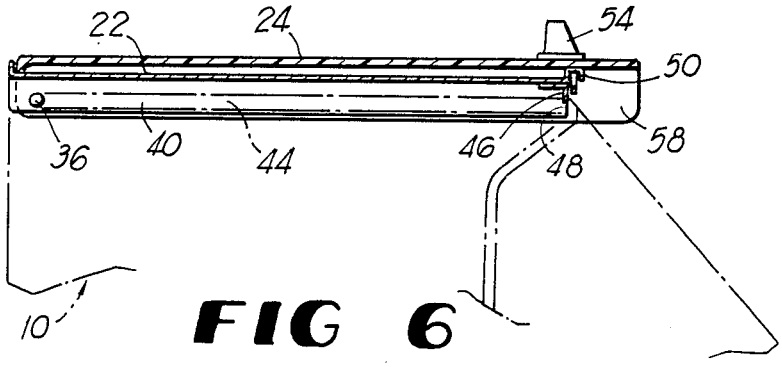
FIGS. 6, 7 and 8 are partially side diagramatic views showing the two covers interlocked, partially slid forward, and completely moved down onto the ice bin, respectively.
Figure 7:
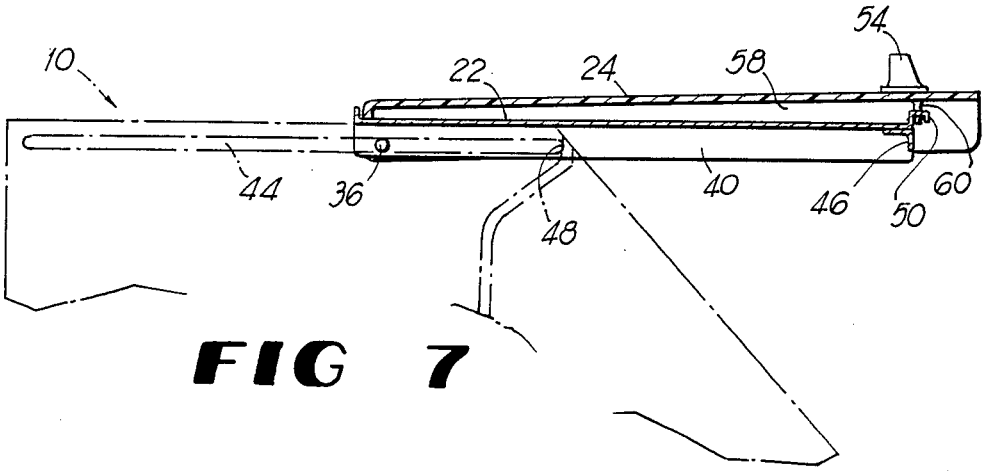
Figure 8:
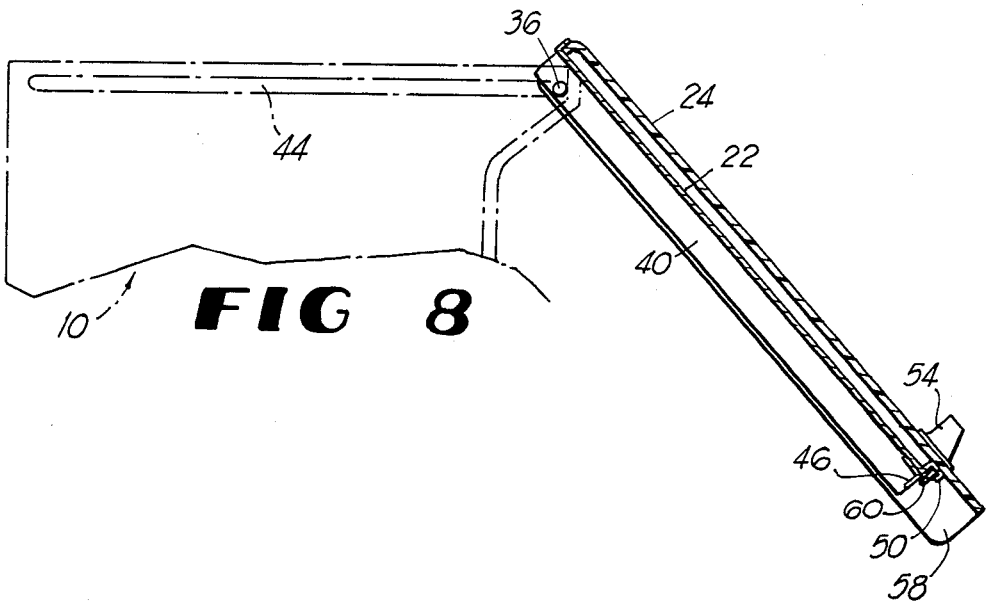

When it is desired to provide access to the syrup tanks 16 in the syrup compartment 14, this is accomplished by grasping the handle 54 of the ice bin cover 24 and lifting the cover 24 and sliding it rearwardly up on top of the syrup compartment cover 22 until it stops (as shown in FIG. 6), and then lifting the front of the ice bin cover just enough to engage or interlock the eyelets and the hooks. The two covers are now interconnected and move together as a unit. Using the handle 54, the two covers are now slid forward (see FIGS. 4 and 7) until the pins 34 and 36 reach the front end of the grooves 42 and 44 at which time the interlocked covers are pivoted downwardly to cover the opening 32 to the ice bin, thus uncovering the opening 30 to the syrup compartment, as shown in FIGS. 5 and 8. The cover 22 is replaced by reversing the above procedure.

It will thus be seen that the cover 22 has only two end positions plus the intermediate positions during the movement of the cover 22 back and forth between such two end positions, namely a first position covering the syrup compartment and a second position covering the ice bin. Therefore, access to the syrup tanks in the syrup compartment can only be provided when the cover 22 is in its second position covering the ice bin.

Figure 9:
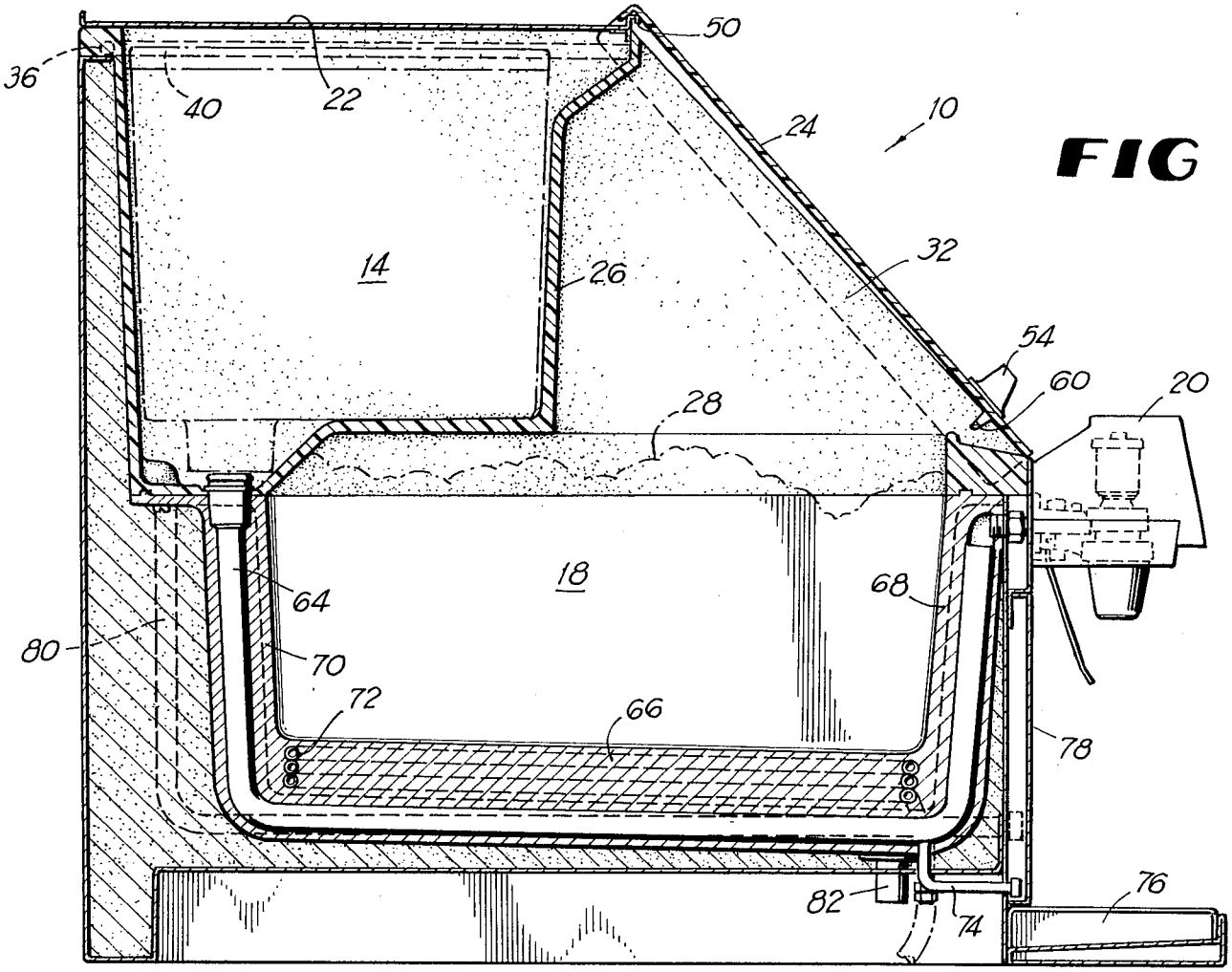
FIG. 9 is a partly cross-sectional side view of the dispenser of FIG. 1.
Figure 10:
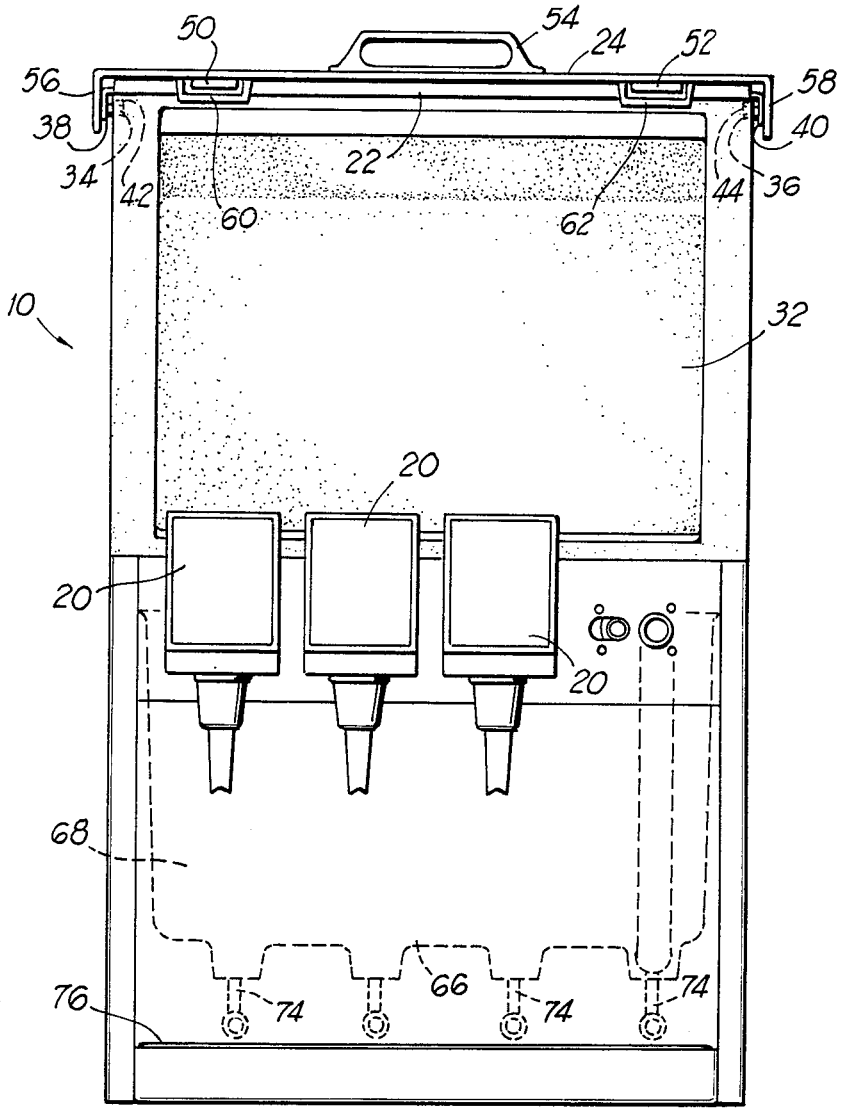
FIG. 10 is a partly cross-sectional front view of the dispenser of FIG 1.
Figure 11:
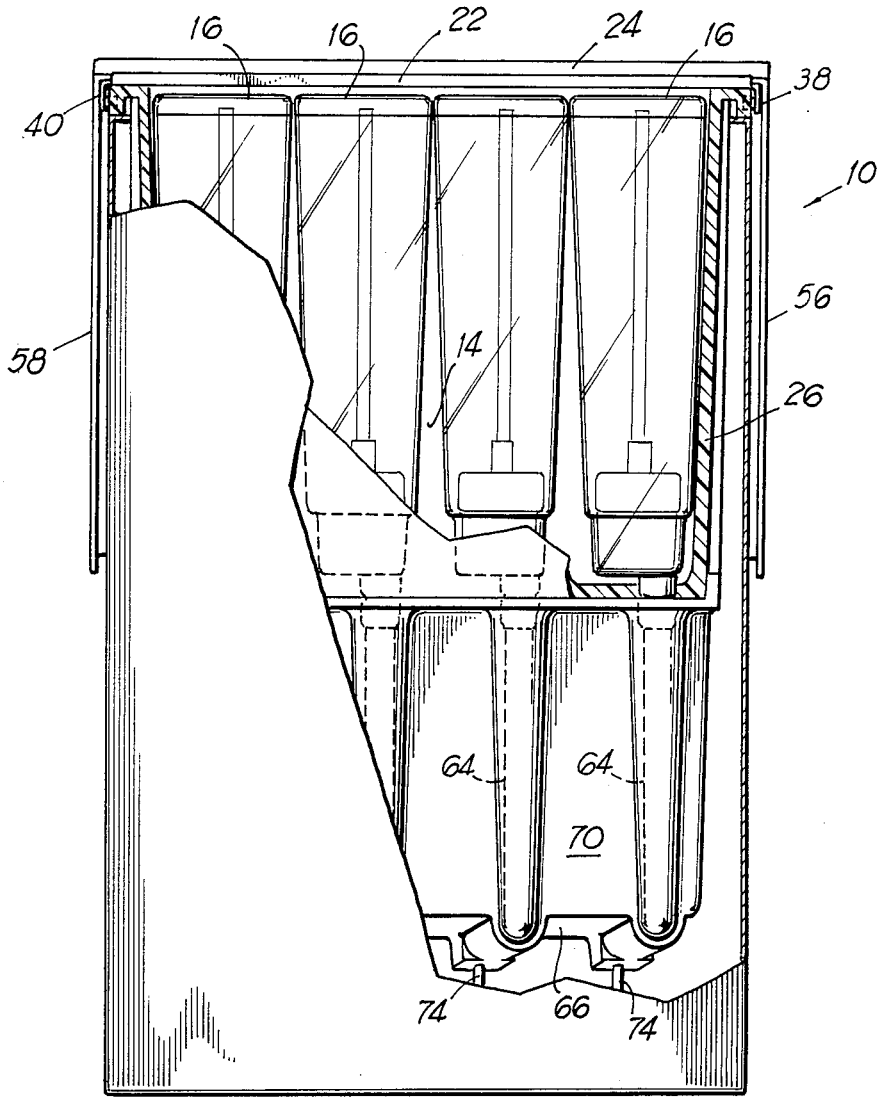
FIG. 11 is a partly cross-sectional rear view of the dispenser of FIG. 1.

Another aspect of the present invention shown in FIGS. 9–11 is that of cooling the syrup. Because the syrup tanks 16 are located in a syrup compartment that is separated from the ice bin, the ice in the ice bin does not cool the mass of syrup located in the syrup tanks. The syrup is flash cooled according to the present invention by providing a syrup tube 64 extending from each of the syrup tanks 16 to a respective one of the dispenser valves 20. The syrup tube 64 is preferably a ¾ inch O.D. stainless steel tube embedded into an aluminum casting that makes up the ice bin 18. The ice bin 18 is in the shape of an open top box having a bottom wall 66, a front wall 68, a rear wall 70 and two side walls. The tube 64 extends down inside the rear wall 70, straight through inside the bottom wall 66 to the front wall 68 and up inside the front wall 68. The entire 24 to 30 inch length of this syrup tube 64 is thus cooled by the ice 28 in the ice bin. The final portion of the tube 64 in the front wall being cooled and opening directly into the dispensing valve 20 eliminates the problem of a warm casual drink. The tubes 64 have a distal opening in a top surface of the rear wall 70 and a proximal opening 71 in a front surface of the front wall 68 (see FIG. 10).

Water cooling conduits 72 are embedded in the ice bin cold plate in a standard and well-known manner, except that they also extend up the front wall 68 to help eliminate the problem of a warm casual drink.

The portion of the syrup tubes 64 in the bottom wall 66 slope slightly downwardly toward the front of the dispenser to a low point, and a drain pipe 74 is connected to the syrup tubes 64 at this low point for use in draining the tubes 64 when desired. A removable stopper is connected to the end of the drain pipe 74 located over a drip pan 76 and behind a splash plate 78. A drain pipe 80 is also provided for draining the syrup compartment and another drain pipe 82 is provided for draining the ice bin.

While the most preferred size for the syrup tube 64 is a $\frac{3}{4}$ inch O.D. tube having about a 0.050 inch wall thickness, a useful range of O.D.s of from about $\frac{5}{8}$ inch to about $1\frac{1}{4}$ inch, and a more preferred range of from about $\frac{5}{8}$ inch to $\frac{7}{8}$ inch would be operable and would provide an acceptable flow rate. This dimension is critical and because the known syrup cooling tubes having a $\frac{5}{8}$ inch O.D. used for flash cooling in known pressurized systems would not work acceptably in the present gravity dispenser because they would not provide a uniform, acceptable flow rate.

While the preferred embodiment of the present invention has been described in detail, it will be understood that this invention is not limited thereto. For example, while an aluminum casting is preferred, it is not essential. The dispenser 10 has four dispensing valves, however, more or less can be used. The syrup tube 64 need not go exactly straight through the bottom wall 66 and it is not necessary that all three layers of water conduits be on top of the syrup tube. If potable ice is not desired, then the syrup tubes can be used alone rather than in combination with a cover arrangement that prevents access to the syrup compartment except when the ice bin is covered. Other sizes and shapes and locations in the dispenser of the various components thereof can be used. If the elimination of a warm casual drink is not of any importance, the front wall 68 and the final portion of the syrup tube 64 can be omitted.

What is claimed is:

1. An ice-cooled gravity beverage dispenser comprising:

(a) a housing;

(b) a syrup compartment in said housing and having an opening for providing access thereto, said syrup compartment being adapted to receive at least one syrup tank therein;

(c) at least one syrup tank located in said syrup compartment and having a removable lid thereon;

(d) an ice bin in said housing and having a cold plate wall and an opening for providing access thereto, said ice bin being adapted to receive cooling ice therein, said syrup compartment including wall means for completely separating said syrup compartment from said ice bin;

(e) at least one dispensing valve mounted on said housing;

(f) a syrup tube having an I.D. of from about $\frac{5}{8}$ inch to about $1\frac{1}{4}$ inch for feeding syrup from said syrup tank to said dispensing valve;

(g) a water conduit for feeding water to said dispensing valve;

(h) said syrup tube and said water conduit being embedded in said cold plate wall of said ice bin for cooling any syrup and water in said tube and conduit, respectively;

(i) a syrup compartment cover fitting over and closing said syrup compartment opening;

(j) said syrup compartment cover being movable back and forth between a first position covering said syrup compartment opening and a second position covering said ice bin opening; and (k) means for preventing said syrup compartment cover from being removed from said housing and for preventing said syrup tank lid from being removed from said syrup tank except when said syrup compartment cover is in said second position, such that access to said syrup tank is provided when said syrup compartment cover is in said second position covering said ice bin.

2. The dispenser as recited in claim 1, wherein said ice bin cold plate wall includes a front wall, said dispensing valve being mounted on said front wall, and said syrup tube is embedded in said front wall and extending up to said dispensing valve inside of said front wall, whereby syrup is kept cool in said syrup tube all the way to said dispensing valve.

3. The dispenser as recited in claim 1, wherein said syrup compartment is located adjacent the rear of said housing and said dispensing valve is mounted on the front of said housing and said ice bin opening is located adjacent the top front of said housing.

4. An ice-cooled gravity beverage dispenser comprising:

(a) a housing;

(b) a syrup compartment in said housing and having an opening for providing access thereto, said syrup compartment being adapted to receive at least one syrup tank therein;

(c) at least one syrup tank located in said syrup compartment and having a removable lid thereon;

(d) an ice bin in said housing and having a cold plate wall and an opening for providing access thereto, said ice bin being adapted to receive cooling ice therein, said syrup compartment including wall means for completely separating said syrup compartment from said ice bin;

(e) at least one dispensing valve mounted on said housing;

(f) a syrup tube having an I.D. of from about $\frac{5}{8}$ inch to about $1\frac{1}{4}$ inch for feeding syrup from said syrup tank to said dispensing valve;

(g) a water conduit for feeding water to said dispensing valve;

(h) said syrup tube and said water conduit being embedded in said cold plate wall of said ice bin for cooling any syrup and water in said tube and conduit, respectively;

(i) a syrup compartment cover fitting over and closing said syrup compartment opening;

(j) said syrup compartment cover being ovable back and forth between a first position covering said syrup compartment opening and a second position covering said ice bin opening;

(k) means for preventing said syrup compartment cover from being removed from said housing and for preventing said syrup tank lid from being removed from said syrup tank except when said syrup compartment cover is in said second position, such that access to said syrup tank is provided when said syrup compartment cover is in said second position covering said ice bin; and (l) said housing including a pair of grooves on opposite sides of said syrup compartment opening and said syrup compartment cover including a pair of pins on opposite sides thereof, said pins being slidably received one each in respective ones of said grooves for allowing said cover to slide back and forth between said two positions.

5. The dispenser as recited in claim 4, wherein said pins are located adjacent the rear of said syrup compartment cover and allow the front of said syrup compartment cover to pivot about said rear thereof.

6. The dispenser as recited in claim 1, including an ice bin cover closing said ice bin opening and movable back and forth between a first position closing said ice bin opening and a second open position providing access into said ice bin.

7. An ice-cooled gravity beverage dispenser comprising:

(a) housing;

(b) a syrup compartment in said housing and having an opening for providing access thereto, said syrup compartment being adapted to receive at least one syrup tank therein;

(c) at least one syrup tank located in said syrup compartment and having a removable lid thereon;

(d) an ice bin in said housing and having a cold plate wall and an opening for providing access thereto, said ice bin being adapted to receive cooling ice therein, said syrup compartment including wall means for completely separating said syrup compartment from said ice bin;

(e) at least one dispensing valve mounted on said housing;

(f) a syrup tube having an I.D. of from about ⅜ inch to about 1¼ inch for feeding syrup from said syrup tank to said dispensing valve;

(g) a water conduit for feeding water to said dispensing valve;

(h) said syrup tube and said water conduit being embedded in said cold plate wall of said ice bin for cooling any syrup and water in said tube and conduit, respectively;

(i) a syrup compartment cover fitting over and closing said syrup compartment opening;

(j) said syrup compartment cover being movable back and forth between a first position covering said syrup compartment opening and a second position covering said ice bin opening;

(k) means for preventing said syrup compartment cover from being removed from said housing and for preventing said syrup tank lid from being removed from said syrup tank except when said syrup compartment cover is in said second position, such that access to said syrup tank is provided when said syrup compartment cover is in said second position covering said ice bin;

(l) an ice bin cover closing said ice bin opening and movable back and forth between a first position closing said ice bin opening and a second open position providing access into said ice bin; and (m) mating interlocking means on said covers for connecting said covers together for movement as a unit when said ice bin is moved on top of said syrup compartment cover, whereby said covers can move together as a unit off of said syrup compartment opening and into position covering said ice bin opening.

8. The dispenser as recited in claim 7, wherein said mating interlocking means comprises a pair of spaced-apart eyelets underneath the front edge of said ice bin cover and a pair of spaced-apart, mating, hooks adjacent the front edge of said syrup compartment cover.

9. The dispenser as recited in claim 7, wherein said ice bin cold plate wall includes a front wall, said dispensing valve is mounted on said front wall, and said syrup tube is embedded into said front wall and extends up to said dispensing valve inside of said front wall, whereby syrup is kept cool in said syrup tube all the way to said dispensing valve.

10. The dispenser as recited in claim 7, wherein said ice bin is an aluminum casting and said syrup tube is a stainless steel tube embedded in the bottom wall of said casting and extends from the rear thereof to the front thereof.

11. The dispenser as recited in claim 10, wherein said ice bin is in the shape of an open top box having a bottom wall, a front wall, a rear wall and two side walls, said syrup compartment is located adjacent the rear of said housing, said dispensing valve is mounted on the front of said housing, said ice bin opening is located adjacent the top front of said housing, wherein said syrup tube extends down said rear wall, through said bottom wall, and up said front wall of said ice bin, and wherein said dispensing valve is mounted on said front wall of said ice bin, whereby syrup is kept cool in said syrup tube all the way to said dispensing valve.

12. The dispenser as recited in claim 11, wherein said syrup tube slopes slightly downwardly toward the front of said dispenser to provide a low point thereof and a drain pipe connected to said syrup tube at said low point and a removable stopper on the end of said drain pipe for draining said syrup tube.

13. The dispenser as recited in claim 10, wherein said syrup tube slopes slightly downwardly toward the front of said dispenser to provide a low point thereof and a drain pipe connected to said syrup tube at said low point and a removable stopper on the end of said drain pipe for draining said syrup tube.

14. The dispenser as recited in claim 1, wherein said ice bin is an aluminum casting and said syrup tube is a stainless steel tube embedded therein, wherein said syrup tube is embedded in the bottom wall of said ice bin and extends from the rear thereof to the front thereof.

15. The dispenser as recited in claim 14, wherein said ice bin is in the shape of an open top box having a bottom wall, a front wall, a rear wall, and two side walls, wherein said syrup compartment is located adjacent the rear of said housing, said dispenser valve is mounted on the front of said housing, said ice bin opening is located adjacent the top front of said housing, said syrup tube also extends down said rear wall and up said front wall of said ice bin, and wherein said dispenser valve is mounted on said front wall of said ice bin, whereby syrup is kept cool in said syrup tube all the way to the dispenser valve.

16. The dispenser as recited in claim 14, wherein said syrup tube slopes slightly downwardly toward the front of said dispenser to provide a low point thereof and a drain pipe connected to said syrup tube at said low point and a removable stopper on the end of said drain pipe for draining said syrup tube.

17. The dispenser as recited in claim 1 wherein said syrup tube has an I.D. of about $\frac{3}{4}$ inch.

18. A method for using the ice in an ice-cooled gravity beverage dispenser also as potable ice in a drink comprising the steps of:

(a) providing said dispenser with a housing having a syrup compartment and an ice bin completely separated from each other by a wall;

(b) providing a syrup tank with a removable lid in the syrup compartment;

(c) cooling syrup by feeding the syrup from the syrup tank to a dispensing valve mounted on the housing through a syrup tube having an I.D. of from about $\frac{5}{8}$ inch to about $1\frac{1}{4}$ inch embedded in a cold plate wall of said ice bin;

(d) cooling water by feeding the water to said dispensing valve through a water conduit embedded in said cold plate wall of said ice bin;

(e) providing a cover on the syrup compartment adapted to move back and forth between a first position covering the syrup compartment and a second position covering the ice bin;

(f) providing means for preventing said cover from moving off of said dispenser and for preventing said syrup tank lid from being removed from said syrup tank except when said syrup compartment cover is in said second position; and (g) providing access to said syrup tank in said syrup compartment by moving said cover from said first position covering said syrup compartment to said second position covering said ice bin.

19. A method for using the ice in an ice-cooled gravity beverage dispenser also as potable ice in a drink comprising the steps of:

(a) providing said dispenser with a housing having a syrup compartment and an ice bin completely separated from each other by a wall;

(b) providing a syrup tank with a removable lid in the syrup compartment;

(c) cooling syrup by feeding the syrup from the syrup tank to a dispensing valve mounted on the housing through a syrup tube having an I.D. of from about $\frac{5}{8}$ inch to about $1\frac{1}{4}$ inch embedded in a cold plate wall of said ice bin;

(d) cooling water by feeding the water to said dispensing valve through a water conduit embedded in said cold plate wall of said ice bin;

(e) providing a cover on the syrup compartment adapted to move back and forth between a first position covering the syrup compartment and a second position covering the ice bin;

(f) providing means for preventing said cover from moving off of said dispenser and for preventing said syrup tank lid from being removed from said syrup tank except when said syrup compartment cover is in said second position;

(g) providing access to said syrup tank in said syrup compartment by moving said cover from said first position covering said syrup compartment to said second position covering said ice bin; and (h) providing an ice bin cover on said ice bin and wherein said step of providing access to said syrup compartment comprises lifting said ice bin cover up on top of said syrup compartment cover, connecting said covers together, and moving both covers together as a unit into position covering said ice bin.

20. The method as recited in claim 19 including the step of feeding the syrup through a final portion of said syrup tube extending vertically upwardly inside of a front cold plate wall of said ice bin and then into said dispensing valve, whereby any syrup in said final portion is cooled by ice in said ice bin to eliminate any warm casual drink.

21. The method as recited in claim 18 including the step of feeding the syrup through a final portion of the syrup tube extending vertically upwardly inside of a front cold plate wall of said ice bin and then into said dispensing valve, whereby any syrup in said final portion is cooled by ice in said ice bin to eliminate any warm casual drink.

22. The method according to claim 18 wherein said tube has an I.D. of about $\frac{3}{4}$ inch.

* * * * *